US008251558B1

(12) United States Patent
Hubert et al.

(10) Patent No.: US 8,251,558 B1
(45) Date of Patent: Aug. 28, 2012

(54) HEADLAMP SYSTEM AND KIT PROVIDING ON-ROAD AND OFF-ROAD ILLUMINATION

(75) Inventors: David E. Hubert, Natrona Heights, PA (US); James M. Helms, Fort Myers, FL (US); Mark R. Barie, Glenshaw, PA (US); Richard P. Lizotte, Hudson, NH (US)

(73) Assignee: Ibis Tek, LLC, Butler, PA (US)

( * ) Notice: Subject to any disclaimer, the term of this patent is extended or adjusted under 35 U.S.C. 154(b) by 251 days.

(21) Appl. No.: 12/803,442

(22) Filed: Jun. 25, 2010

Related U.S. Application Data

(60) Provisional application No. 61/273,620, filed on Aug. 6, 2009.

(51) Int. Cl.
*F21V 19/02* (2006.01)
*F21V 21/14* (2006.01)

(52) U.S. Cl. ..... 362/529; 362/420; 362/427; 362/507; 362/514; 362/525

(58) Field of Classification Search ..... 362/418–430, 362/459–468, 475–476, 507–508, 512–515, 362/523–532
See application file for complete search history.

(56) References Cited

U.S. PATENT DOCUMENTS 4,739,223 A * 4/1988 Baba et al. ..... 315/82

* cited by examiner

*Primary Examiner* — Jason Moon Han
(74) *Attorney, Agent, or Firm* — Karen Tang-Wai Sodini

(57) ABSTRACT

A vehicular headlamp system and corresponding kit, including (left and right) headlamps and a mode switch (control mechanism) responsive to inputs from a mode switch console or other user interface arrangements, the combination of headlamps and mode switch providing high and low beam on-road illumination and a higher level of illumination for off-road illumination using the same light source in each headlamp as is used for the on-road illumination. Cooperation between a light source driver circuit in each headlamp and the mode switch results in the light source in each headlamp being driven by more or less current, as required by the selected mode. A (daytime) running lights mode of operation may also be provided using the same light source.

11 Claims, 9 Drawing Sheets

HEADLAMP SYSTEM AND KIT PROVIDING ON-ROAD AND OFF-ROAD ILLUMINATION

CROSS REFERENCE TO RELATED APPLICATIONS

Reference is made to and priority claimed from U.S. provisional application Ser. No. 61/273,620 filed on Aug. 6, 2009.

FIELD OF THE INVENTION

The present invention opertains to the field of lighting or illumination. More particularly, the present invention pertains to the field of vehicle headlamps having variable beam settings.

BACKGROUND OF THE INVENTION

The Federal Motor Vehicle Safety Standard (FMVSS) 108 for on-road vehicle lighting requires headlamps to generate high beam and low beam patterns defined by an array of points at each of which the beams are required to have an intensity within a specified range. Typically, high beams and low beams provided by a headlamp are achieved using one incandescent light source with a reflector designed to generate a high beam, and another such light source with a reflector designed to generate a low beam. In such headlamps then, two different incandescent light sources and two different reflectors are used to generate the two beam patterns.

The FMVSS requirements do not specify the brightness of headlamps for off-road applications because there is no concern about headlamp glare blinding other drivers off-road; thus off-road headlamps can have much higher light intensities than allowed by FMVSS 108.

It would be useful to have a headlamp that can provide a high beam or a low beam for on-road use, and yet can easily switch to a mode in which illumination is provided suitable for off-road use. It would be further desirable to have a headlamp that minimizes the number of internal components to achieve both an on-road and off-road headlamp, so as to reduce costs.

SUMMARY OF THE INVENTION

The present invention provides a vehicular headlamp system including two vehicular headlamps for use as a right and left headlamps, each using a respective single light source, typically an LED light source, to give both a high beam and low beam for on-road illumination, and to give at least one further beam for off-road illumination. The vehicular headlamp system also includes a control mechanism, called here a mode switch, for selecting which of the different beams to use, i.e. for selecting a mode of operation. The mode switch connects to any of a number of different possible user interface arrangements for commanding the mode switch to cause a selection on one or another mode of operation of the headlamps. One such arrangement could be a mode switch console, having buttons or rotary switches or the like for indicating a selection by a vehicle occupant of one or another mode of operation.

Thus, the same light source in each headlamp is used for all beams provided by the headlamp. The light source may be a single light or a plurality of individual lights, as is typically the case for a so-called high-power LED light. The off-road illumination according to the invention differs from the on-road illumination in the intensity of the beam, i.e. in the brightness of the beam, as measured for example by total radiated power. (An LED light source can be operated to provide one or another intensity/radiated power by providing a corresponding operating current, also called a driving current.)

To enable using a single light source for both on-road and off-road high and low beams, a multifaceted reflector may be pivoted in each headlamp so as to change the position of the reflector relative to the light source giving a low beam and a high beam, and, in addition, the intensity of the light source may be varied to give both an on-road intensity of illumination and a higher, off-road intensity of illumination. Such an embodiment would therefore provide four beams: on-road low-beam, on-road high-beam, off-road-low beam, and off-road high-beam. In some other embodiments, though, a single off-road beam could be provided.

A vehicular headlamp system according to the invention may be further configured so as to use the same light source to provide a running lights beam, commonly referred to in the industry as daytime running lights. This could be done by providing that the "off" position for the headlamp results in activating a running lights mode of operation, which could be provided with the light source or reflector pivoted or disposed for low beam operation, and with a lower current used as the driving current than is used for low beam on-road operation.

The invention also provides a kit furnishing components of a vehicular headlamp system according to the invention.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
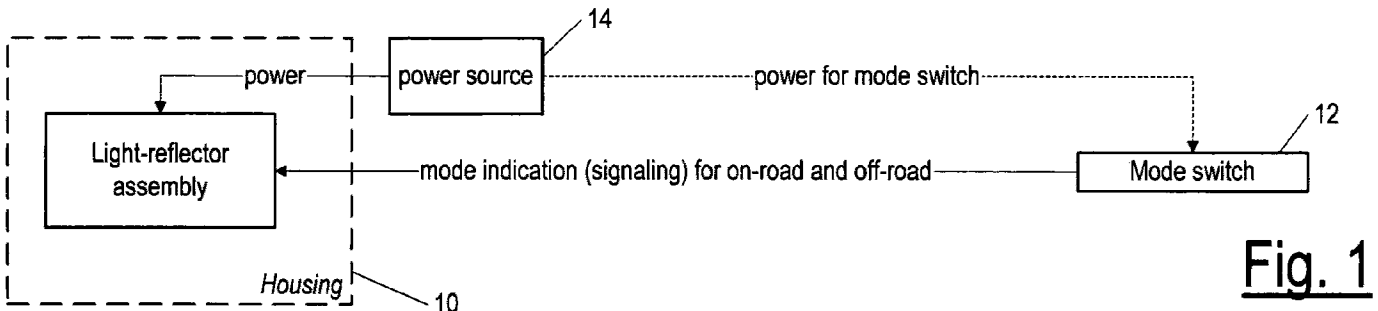
FIG. 1 is a block/flow diagram showing a mode switch in communication with a light-reflector assembly of a vehicular headlamp, in an embodiment of the invention in which the mode switch signals to the light-reflector assembly to operate according to one or another mode.

The following is a list of reference labels used in the drawings to label components of different embodiments of the invention, and the names of the indicated components.

| | |
|---|---|
| 10 | housing (for headlamp) |
| 10a | base of housing |
| 10b | cover of housing |
| 10c | opaque portion of cover |
| 10d | light-transmissive portion of cover |
| 11 | light-reflector assembly |
| 11a | light source |
| 11b | reflector (optics) |
| 11c | light source driver circuit (current/power regulator) |
| 11d | actuator |
| 11e | mode activator |
| 11f | main driver circuit |
| 11g | control arm |
| 12 | mode switch |
| 14 | power source |
| 15a-d | poles of single-pole double-throw switches (in mode switch) |
| 15e | (single-pole single-throw) switch (in mode switch) |
| 16 | mode switch console |
| 16a-c | switches in mode switch console |
| 17 | relay |
| 21 | CAN bus |

DETAILED DESCRIPTION

Figure 2:
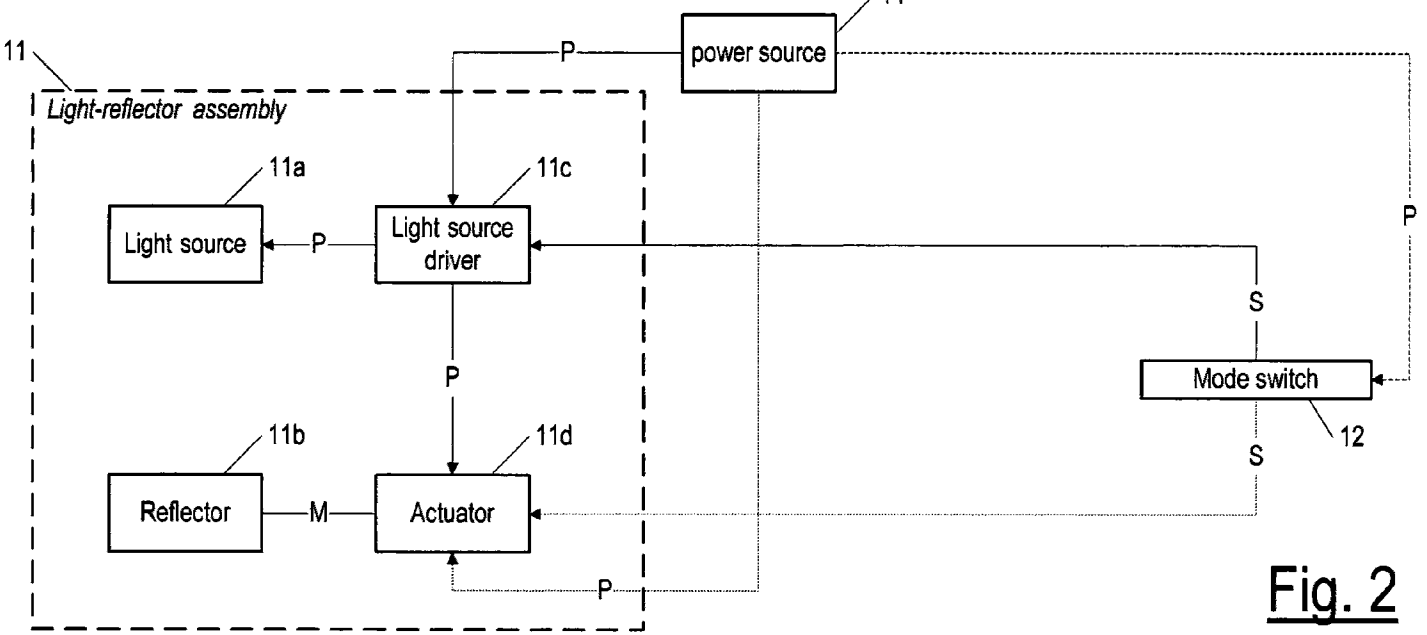
FIG. 2 is a block/flow diagram showing the light-reflector assembly of FIG. 1 in more detail, including a light source and a light source driver circuit for providing driving current to the light source.
Figure 4:
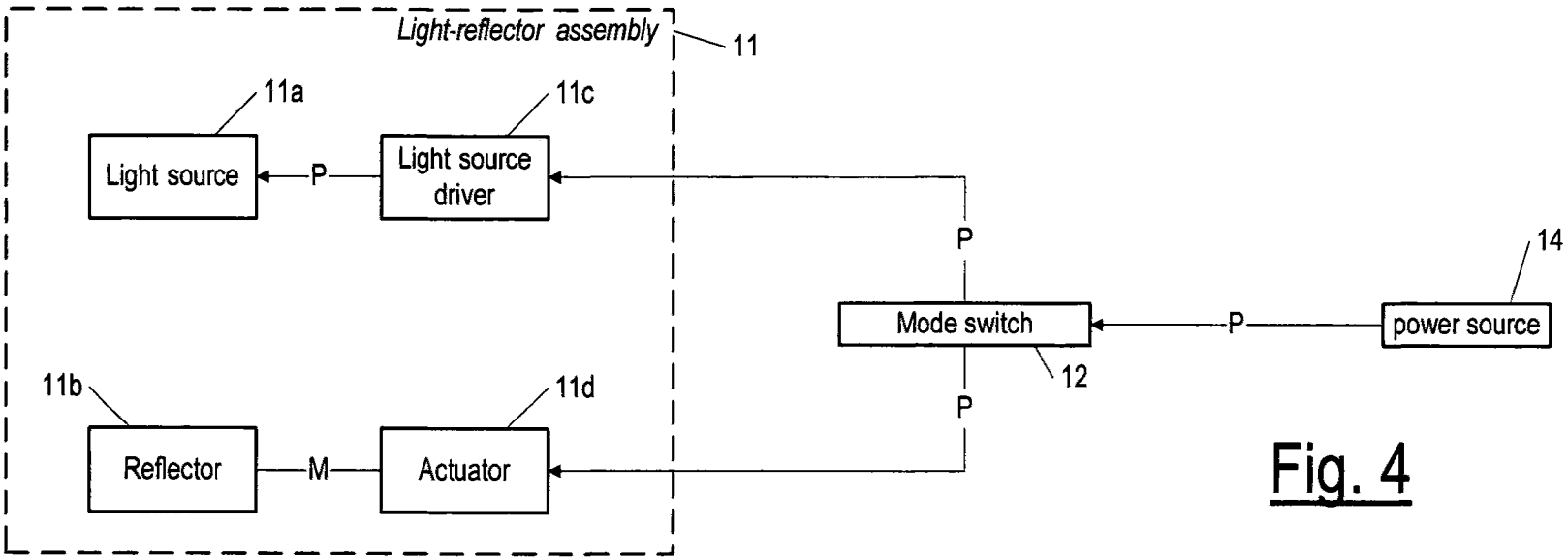
FIG. 4 is a block/flow diagram showing a mode switch in communication with a light-reflector assembly of a vehicular headlamp including a light source, in an embodiment in which the mode switch is connected to the power source for the light source and the operating current for the light source is provided via the mode switch.

Referring now to FIGS. 1, 2, and 4 a vehicular headlamp system according to some embodiments of the invention is shown as comprising a light-reflector assembly 11 mounted in a housing 10 for installing on a vehicle (not shown) as a front (left or right) headlamp. The light-reflector assembly includes a single light source 11*a* and a pivotably mounted reflector lib, also referred to using the term "optics" since the reflector is used to form or shape light from the light source into a desired beam. The light source may be comprised of several individual lights, as is customary in providing a so-called high-power LED. Regardless of the number of lights used as the single light source, the point to be stressed is that a headlamp according to the invention uses the same light source for all the different beams provided by the headlamp, as described below, and all lights of the light source are illuminated for each beam, but to varying degrees, depending on the selected beam.

In all embodiments of the invention, the light source 11*a* is powered from a power source 14, via a light source driver circuit 11*c*. Power for the light source (and more specifically the current component of power) is always provided via the light source driver, but in some embodiments—e.g. those illustrated in FIGS. 1-3, 8 and 9—power flows directly to the light source driver (circuit) from the power source, i.e. without flowing through the mode switch 12, and in other embodiments flows through the mode switch 12, as will be described below by reference to FIGS. 4, 6 and 7. In all embodiments, though, it is the cooperation between the mode switch, the light source driver circuit, and the actuator that results in one or another of the various possible beams/modes of operation.

Thus, in the embodiments shown in FIGS. 1, 2, and 4 (and also FIGS. 3, 8 and 9), power from the power source 14 does not flow through the mode switch. Instead, the mode switch controls the light source driver via signaling current or via data messages, and the light source driver then draws current from the power source for powering the light source, according to the mode of operation selected by a vehicle occupant using the mode switch.

Figure 10A:
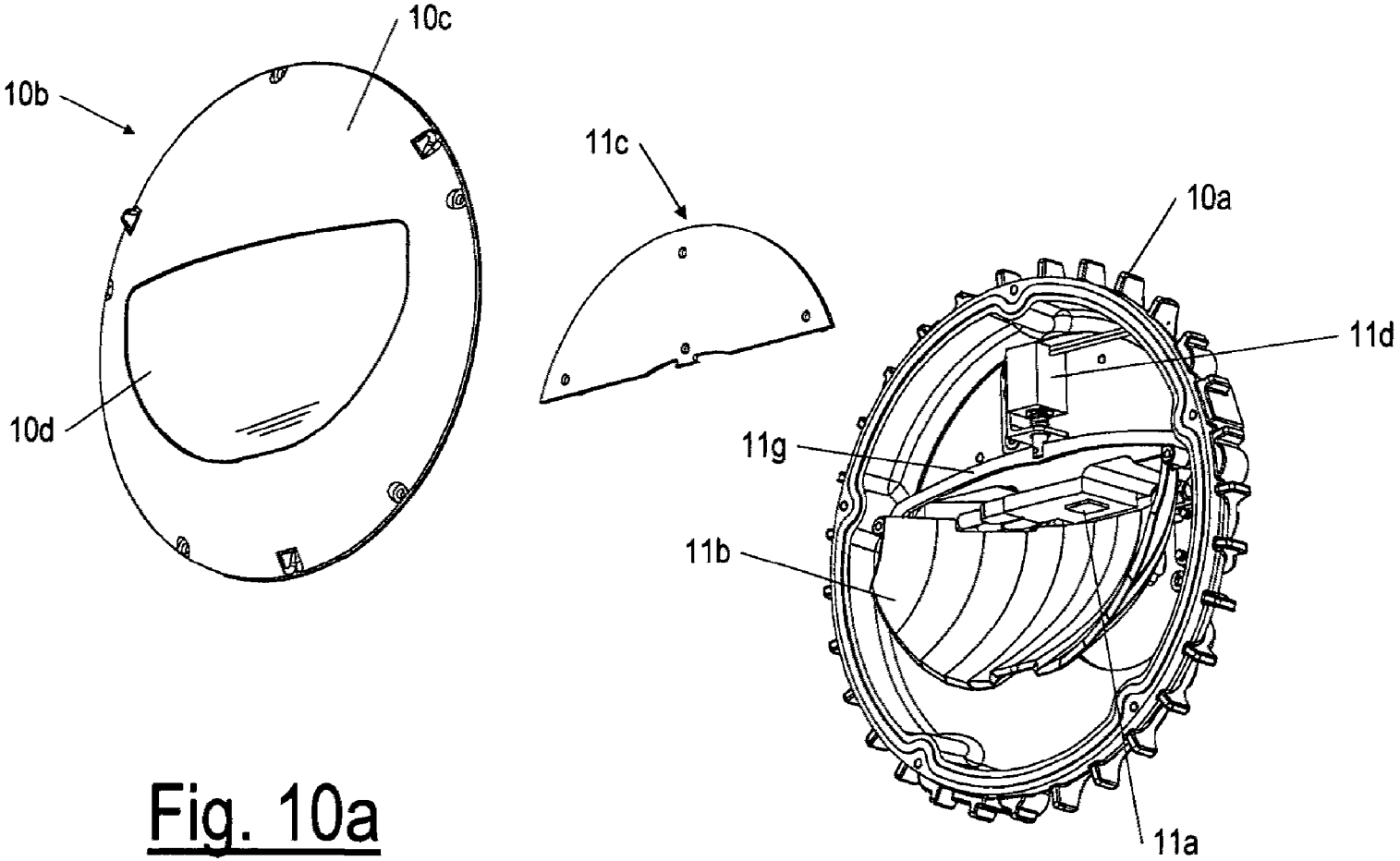
FIGS. 10*a* and 10*b* are perspective exploded drawings of a vehicular headlamp that can be provided according to the invention.
Figure 10B:
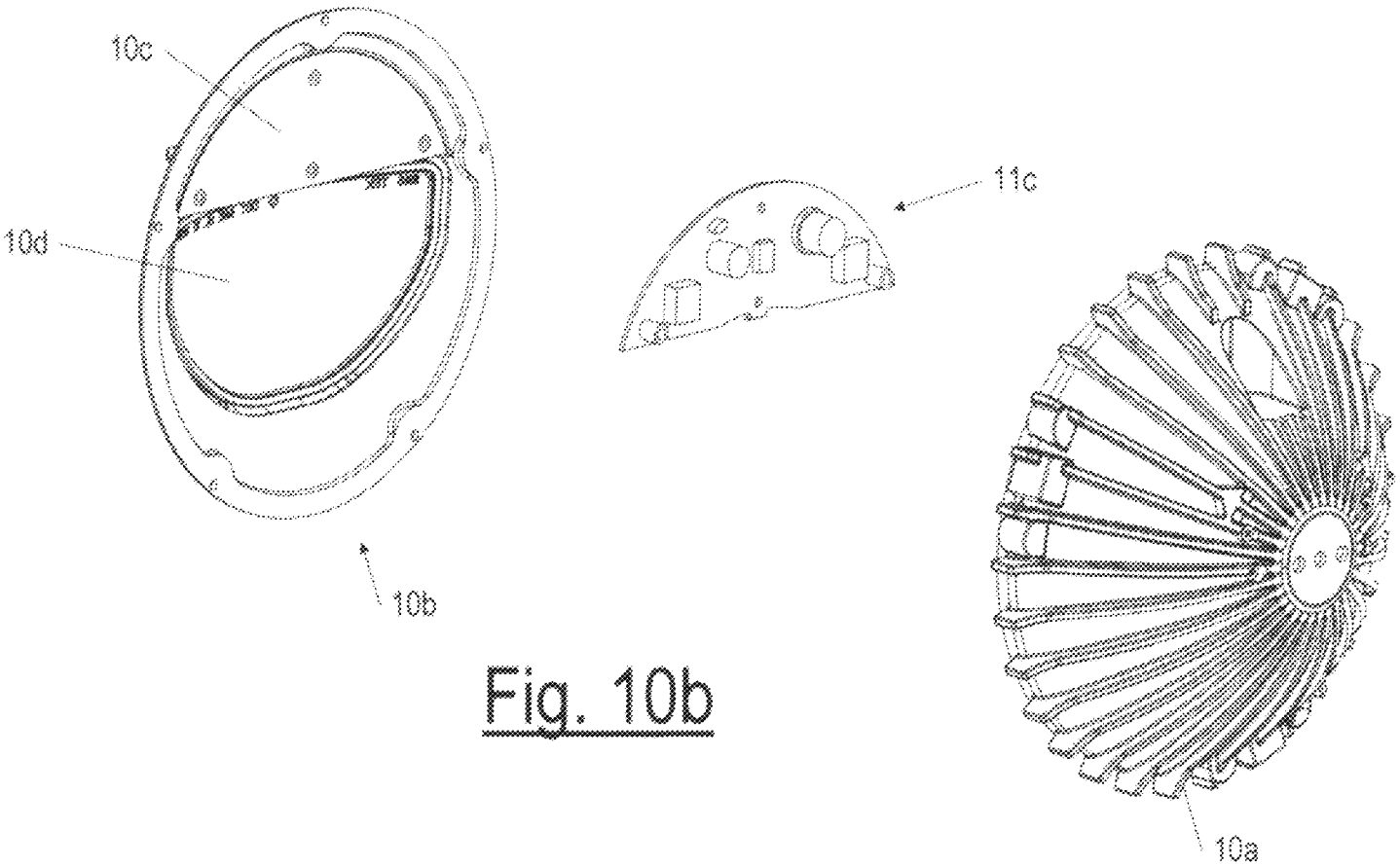

As shown in FIG. 2 and also FIGS. 10*a* and 10*b*, the light-reflector assembly 11 includes an actuator 11*d* mechanically coupled to the reflector 11*b*, and, in these embodiments, electrically coupled to the light source driver for receiving power for powering the actuator to pivot the reflector from a high-beam orientation to a low-beam orientation (or vice versa). In FIG. 2, there is shown a dashed signaling coupling of the mode switch 12 to the actuator, to indicate that in some embodiments, as in that shown in FIG. 8 and discussed below, the actuator may receive signaling/data messages from the mode switch and then draw power from the power source (or from the light source driver) to pivot the reflector accordingly.

Referring now for the moment to FIGS. 10*a* and 10*b*, a vehicular headlamp of the sort in which control of the light-reflector assembly according to the invention can be implemented is shown as including, as components of the housing 10 (FIG. 1), a housing base 10*a*, of generally bulbous form having a hollowed out interior, and a cover 10*b* for covering the base. The cover includes an opaque portion 10*c* and a light-transmissive portion 10*d*. The reflector 11*b* is shown mounted generally behind where the light-transmissive portion of the cover is disposed when the cover is in place. The light source 11*a* is shown mounted above the reflector so that light coming from the light source strikes the surface of the reflector and is reflected through the light-transmissive portion of the cover at an angle depending on the orientation of the reflector, which is changed by action of the actuator 11*d*. Power applied to the actuator can cause the actuator to push (or pull) on a control arm 11*g*, thereby causing the reflector to pivot about points of attachment to the housing base. When the reflector is in a more upward orientation, a high-beam is provided. As shown in FIGS. 10*a* and 10*b*, the light source driver circuit 11*c* is typically provided as components mounted on a substrate, and is then attached to the housing, and in the embodiment shown, the attachment to the housing is via an attachment to the cover of the housing (see FIG. 10*b*) via fasteners (not shown). It is also possible to keep the two driver circuits, one for each headlamp, mounted outside of the housings and away from the headlamps, and possibly included together as a single module.

Figure 5:
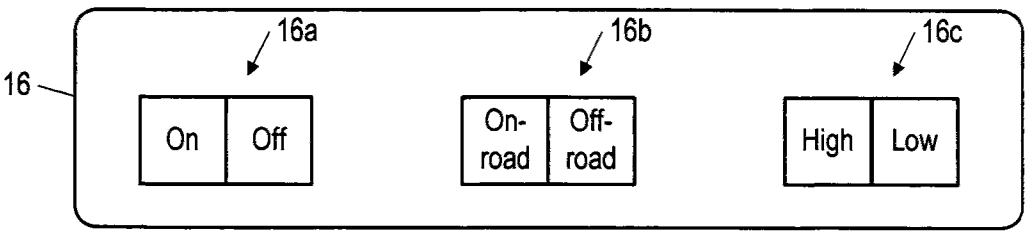
FIG. 5 is a depiction of a mode switch, including an on/off switch, for use with a vehicular headlamp according to the invention, in an embodiment in which the headlamp is configured to provide an on-road high and low beam, and also an off-road high and low beam, and, optionally, a running lights beam (triggered by pushing the on/off switch to off).

Referring now also to FIG. 5, a mode switch 12 (shown in FIGS. 1-4, and FIGS. 6-9) appropriate for the embodiments described here may have an interface to a console 16—serving as a user interface to the mode switch—having an on/off switch 16*a*, a high-beam/low-beam switch 16*c*, and an on-road/off-road switch 16*b*. Thus, a vehicle occupant can turn the headlamps "off," which, in some embodiments, would result in a (daytime) running lights only mode of operation, i.e. the light source would be driven by the light source driver using a current appropriate not for illumination, but for indicating to other drivers that the vehicle is in operation. The running lights mode could use either a high-beam or a low-beam reflector position, depending on what orientation the reflector has when the actuator is not engaged. In other embodiments, selecting "off" would simply stop current from being provided to the light source (by the light source driver circuit), so that the light source is in fact off.

Referring still to FIG. 5, a vehicle occupant can turn the headlamps to a low-beam on-road mode of operation by selecting off-road using the on-road/off-road switch 16*b*, and also selecting low (beam), using the high (beam)/low (beam) switch 16*c*. To switch to an off-road low-beam, starting from an on-road low-beam mode of operation, the vehicle occupant need only select off-road using the on-road/off-road switch 16*b*. The on-road and off-road high-beam modes of operation can be activated similarly.

In some embodiments the mode switch may not interface with a console (user interface to the mode switch) per se, i.e. a single distinct device, but would interface with an arrangement of user interface tools incorporated into elements of the operator controls. For example, all or some of the mode switching for a vehicle could be performed using a user interface to the mode switch, or mode selector means, built into elements of the vehicle's steering column. For example, a driver could pull and release a control arm protruding from the steering column toward the driver one time to toggle between high beam and low beam, and the driver could pull and release the control twice in rather rapid succession to engage an off-road mode of operation, using either the high-beam or low-beam, depending on what beam was engaged at the point in time when the off-road mode of operation was invoked. Then the driver could toggle between high-beam and low-beam using the same control arm using a single pull and release, and finally, return to on-road illumination by again twice pulling and releasing the control arm. In such embodiments, the headlamps may be turned on and off (leaving running lights on in some embodiments) using a switch on the steering column or on the vehicle facia (instrument panel and dashboard area), or the lights may turn on and off automatically based on a light sensor embedded in the vehicle so as to provide an indication of reduced lighting.

Figure 3:
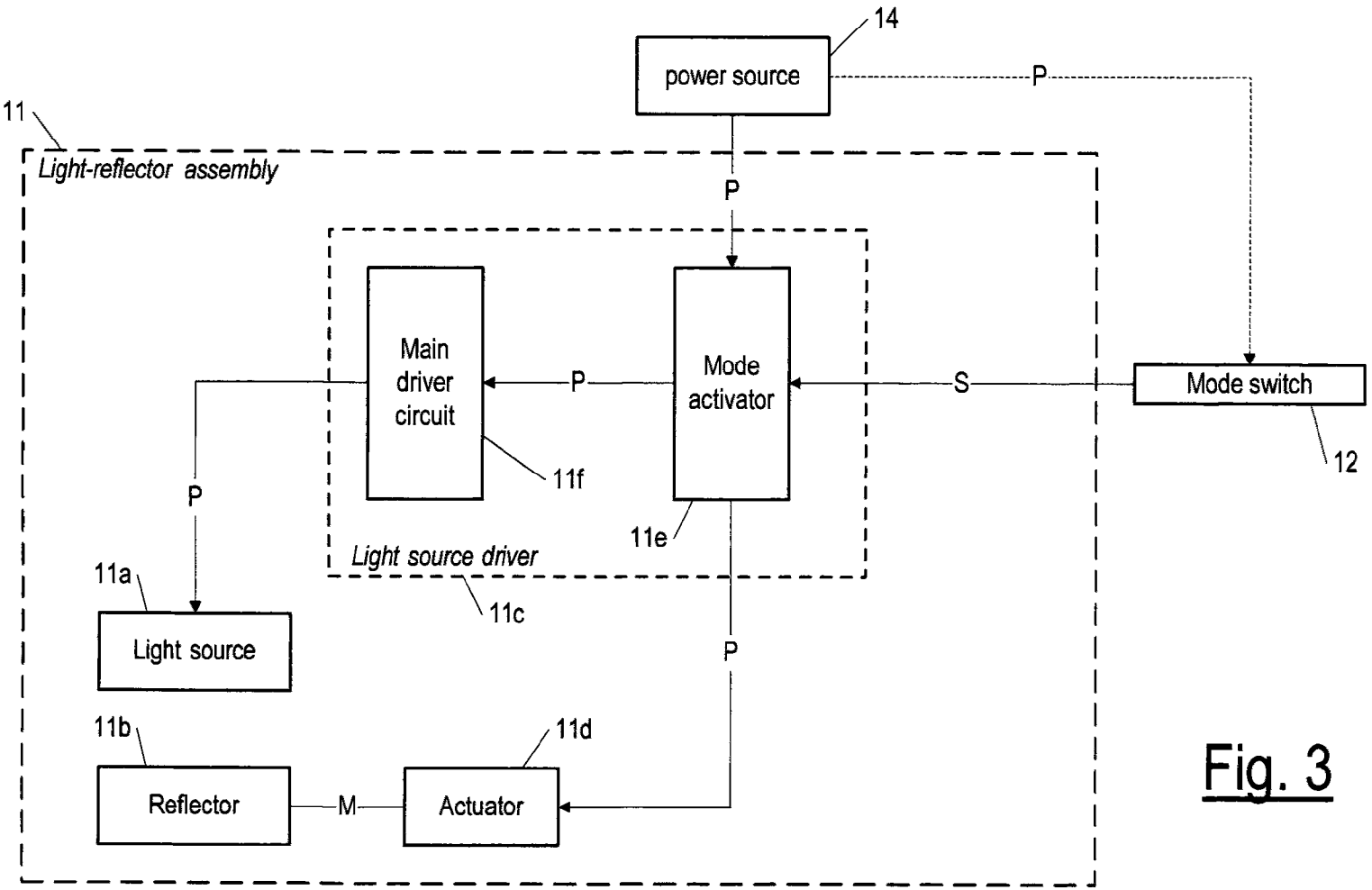
FIG. 3 is a block/flow diagram showing an embodiment of the light source driver.
Figure 8:
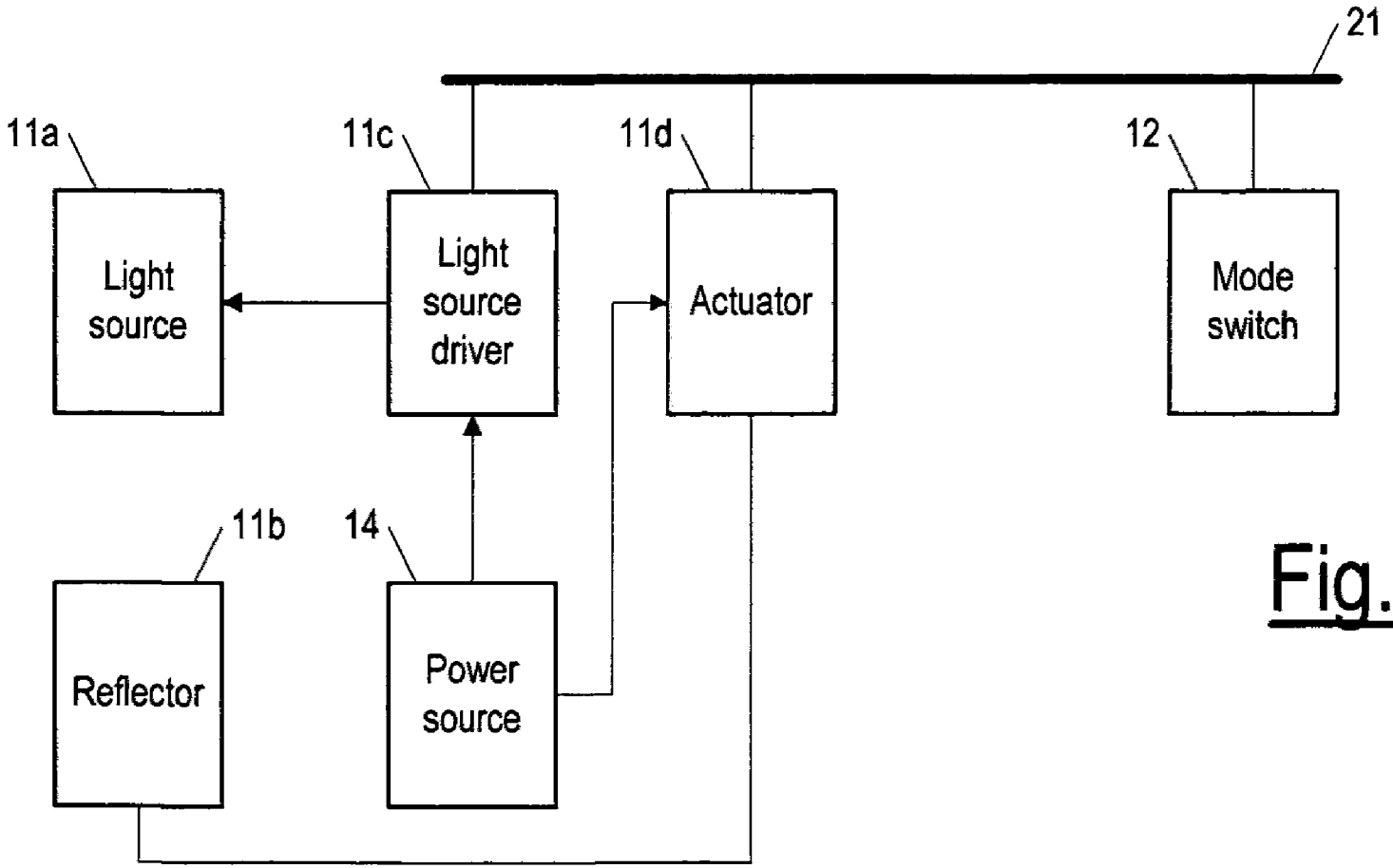
FIG. 8 is a schematic diagram/block diagram showing an embodiment of a light-reflector assembly of FIGS. 1 and 2, in which the mode switch signals to an actuator and light source driver by transmitting data messages via an electrical bus.

Referring now to FIG. 3, an embodiment is shown there in which the mode switch 12 signals to a mode activator component 11*e* of the light source driver so as to engage one or another of the possible modes of operation. In such signaling, the mode switch would typically be powered (to provide the signaling capability) by the same power source as would be used to provide power to the light source 11*a*, and such powering of the mode switch is shown in FIG. 3 by a dotted line directed from the power source to the mode switch and labeled "P" to show such powering of the mode switch. (A coupling labeled "M" as is shown in FIG. 2 between the actuator and reflector is so labeled to indicate a purely mechanical coupling.) The mode activator then draws power from the power source (indicated by a line directed from the power source to the mode activator and again labeled "P") and provides regulated power (a desired current at an operating voltage, where the current is set by the mode activator) to a main driver circuit component 11*f*. As will be better understood in connection with the description of the embodiment shown in FIG. 6, the mode activator in effect selects one or another set resistor, thereby determining the current the main driver circuit 11*f* provides to the light source 11*a*. In so doing, a mode activator according to the invention could either actually select one or another set resistor or combination of resistors that provide a desired resistance, thereby setting the operating current for the light source, or instead providing an electronically regulated current that is, on average, a desired operating current. The signaling by the mode switch to the mode activator could be, for example, a signaling voltage pulse (different levels), or patterns of signaling voltage pulses, or digital signals e.g. via TCP/IP. An alternative to TCP/IP for digital signaling is to use a so-called and standardized Controller Area Network (CAN) or CAN-bus system, as shown in FIG. 8. In the embodiment shown in FIG. 8, however, unlike in the embodiment shown in FIG. 3, power for enabling the actuator 11*d* flows directly from the power source to the actuator, after signaling from the mode switch to the actuator via a CAN bus 21, according to the CAN standard.

For on-road beam generation, the high beam and low beams are, for purposes here, defined by respective photometry requirements, each of which may be understood as specifying a beam intensity or range of intensities at each of a plurality of spatially separated co-planar points. In order to satisfy the low beam and high beam photometry requirements using the same light source and the same pivotable reflector, the reflector is designed so that when it is in its low beam position, the hot spot is closer to the center vertical line of beam symmetry than the hot spot is typically found for a low beam, and when the actuator is energized so that the reflector is pivoted, switching from the low beam to the high beam, the hot spot is shifted upward to cover the so-called "HV point"—the point at which the horizontal line of beam symmetry and the vertical line of beam symmetry cross each other. This design approach facilitates satisfying high beam photometry requirements. The angle of rotation of the reflector is typically only a couple of degrees.

For off-road beam generation, the high and low beams are not restricted by FMVSS requirements and feature increased luminosity compared to on-road illumination.

Referring now to FIG. 4, an embodiment is shown in which power for the light source 11*a* and actuator 11*d* flows through the mode switch 12. In one such embodiment, and now referring also to FIG. 6, the mode switch 12 contains switches for controlling which of different possible set resistors $R_1$, $R_2$, and $R_3$ are connected to the power source 14, and so are connected into or disconnected from the main driver circuit 11*f*. A (single-pole double-throw) switch for on and "off" (i.e. for running lights) includes a first terminal 15*a* for turning on running lights only, which is done by connecting set resistor $R_1$ to the power source 14, and a second terminal 15*b* for connecting resistor $R_3$ to the power source. There is another set resistor $R_2$ in this embodiment, and if this other resistor is not also connected to the power source via (single pole single throw) switch 15*e*, then the final set resistance is just $R_3$, which would be used to set the on-road mode of operation (for either high beam or low beam). Whether the resulting beam is the high beam or the low beam is controlled using the (single pole double throw) switch having terminals 15*c* 15*d*, where when terminal 15*d* is connected to the power source, power flows not only to the light source 11*a* (through the main circuit driver) but also to the actuator 11*d*. To select the off-road mode of operation, switch 15*e* is used, with the result that set resistor $R_2$ is also connected to the power source 14, in parallel with set resistor $R_3$. The two resistors in combination determine the effective set resistance (lower than either just $R_2$ or just $R_3$), with the result that the light source receives (i.e. is driven by) a higher (operating) current.

Figure 6:
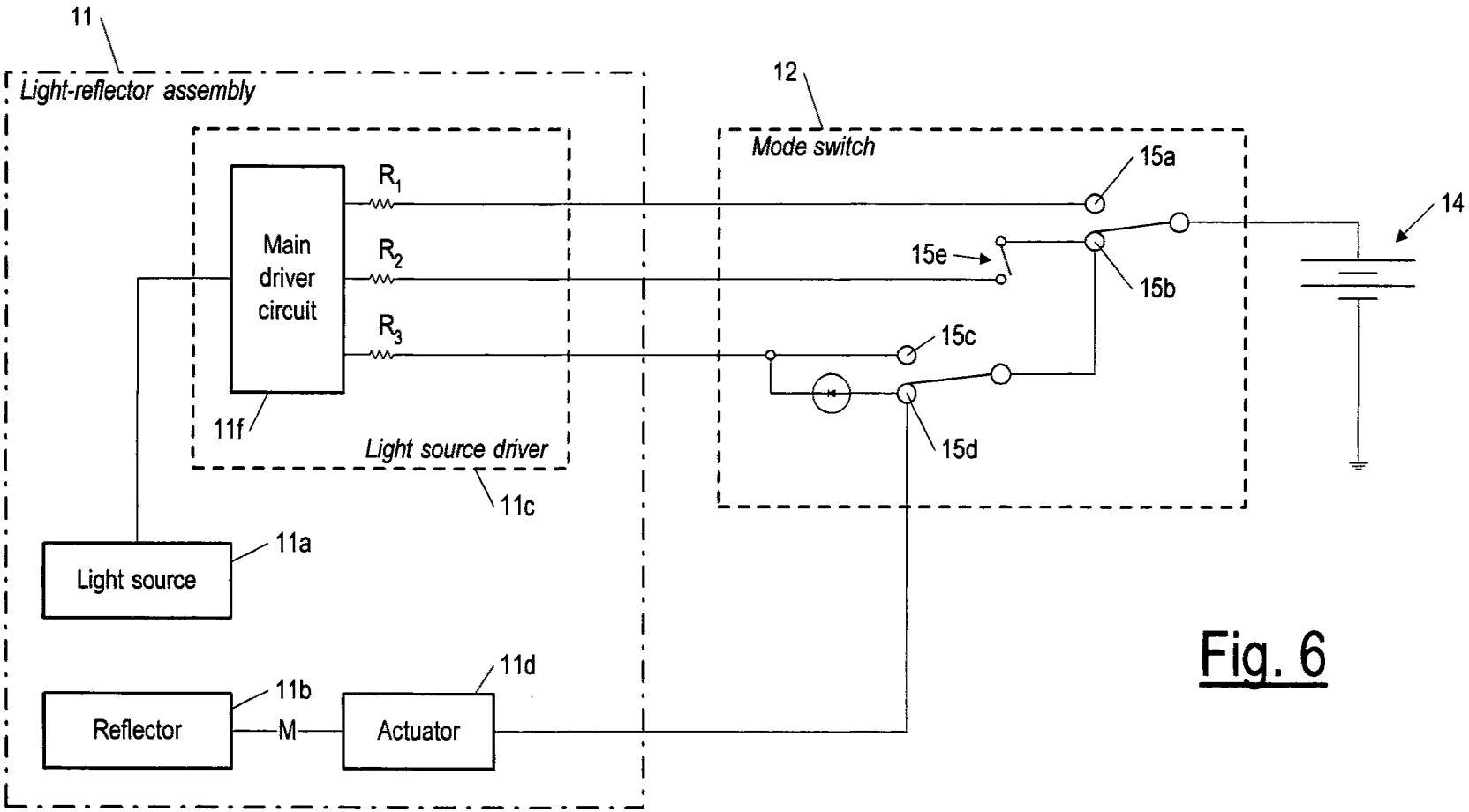
FIG. 6 is a schematic diagram/block diagram showing an embodiment of the light-reflector assembly of FIG. 4, in which set resistors for setting the operating current for different modes of operation are provided as part of the light-reflector assembly, and showing an illustrative embodiment of the mode switch.
Figure 7:
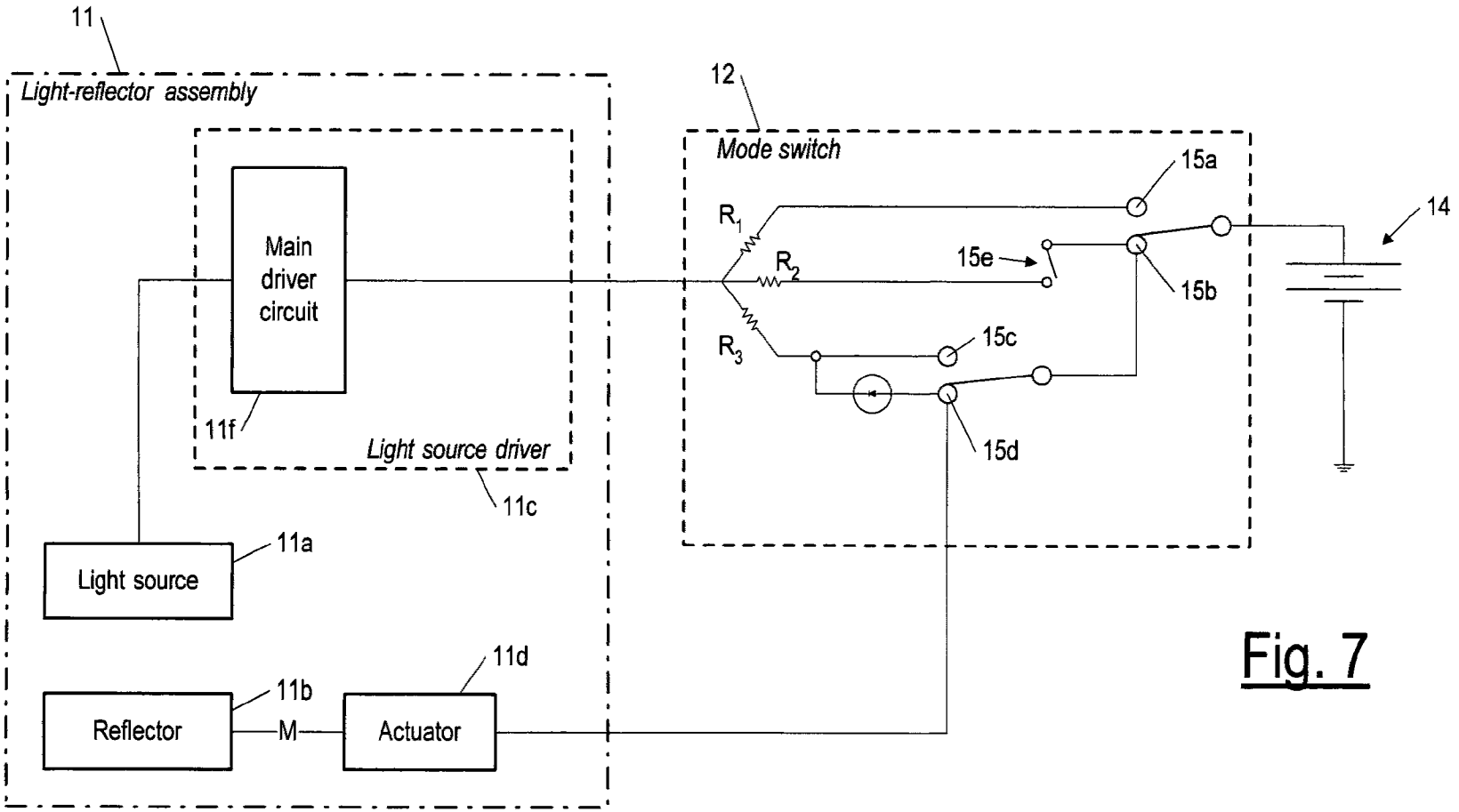
FIG. 7 is a schematic diagram/block diagram showing an embodiment similar to that shown in FIG. 6, but where set resistors are included in the mode switch.

Referring now to FIG. 7, an embodiment is shown there similar in all respects to that shown in FIG. 6, except that the set resistors are included in the mode switch, instead of in each headlamp. (The resistors therefore would be different in resistive value than in the embodiment shown in FIG. 6.)

Figure 9:
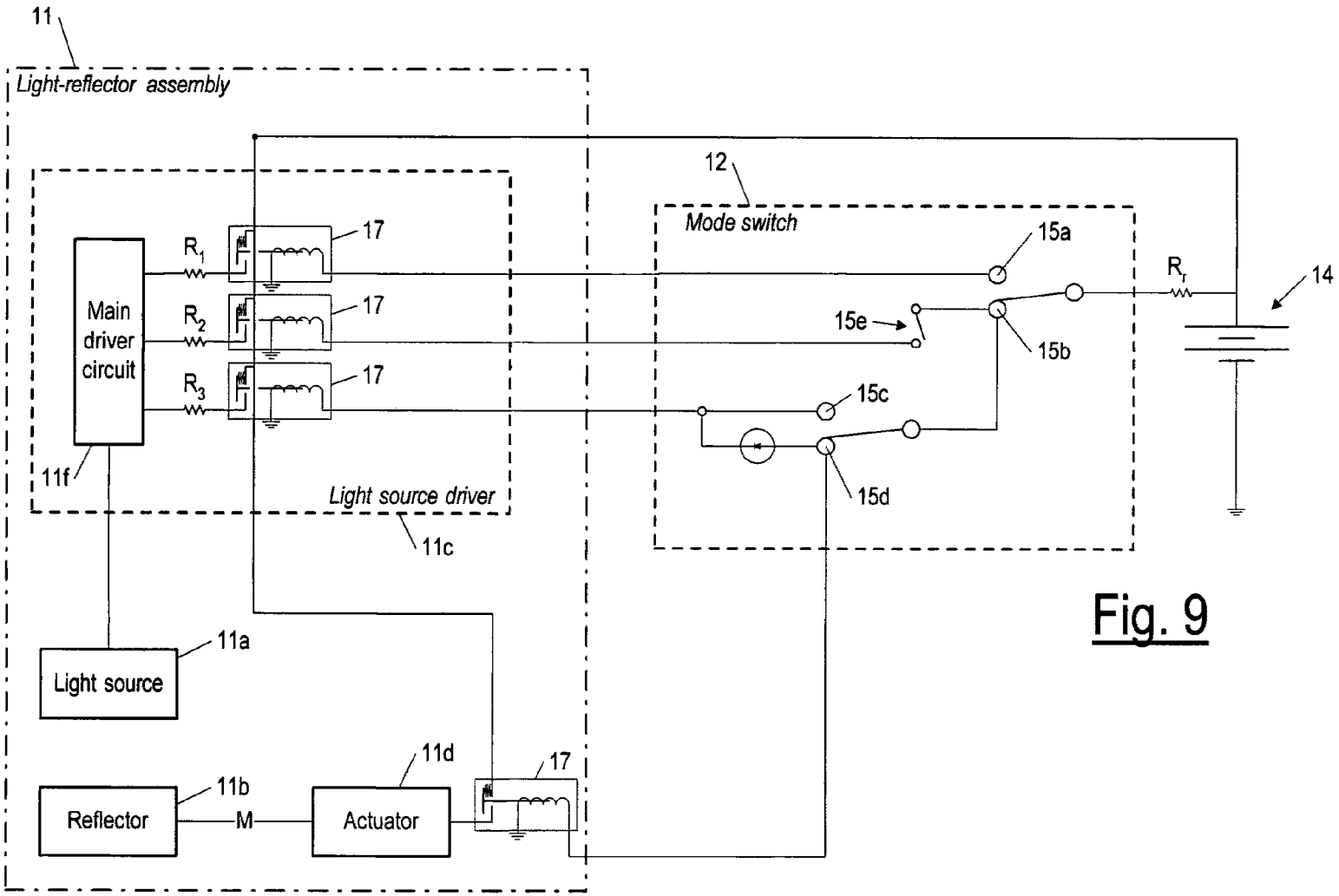
FIG. 9 is a schematic/block diagram of another embodiment of the light-reflector assembly of FIGS. 1 and 2, an embodiment in which instead of signaling by transmitting data messages, the mode switch provides current to open and close relays through which power is provided to the light source.

Referring now to FIGS. 8 and 9, embodiments are shown there along the lines of the embodiment laid out in FIG. 2, except that power for the actuator in FIG. 8 flows directly from the power source to the actuator, and does so at least arguably in FIG. 9 (though there the path taken by the power may be a path through the light source driver circuit).

As described above, the embodiment shown in FIG. 8 is based on a CAN-bus system of control, in which the mode switch 12 sends (digital) messages to the actuator 11*d* and light source driver 11*c*, so as to engage one or another mode of operation. Thus, each of these components is implemented according to the CAN-bus standard, and includes a sender and/or receiver component for sending and/or receiving CAN messages. The mode switch may for example issue a message (command) to engage the off-road high-beam mode of operation, in which case the actuator component would react to the message (by pivoting the reflector to the high-beam position if it was not already so pivoted) and to do so would connect a relay component to the power source, and the light source driver would react to the message (command) by connecting to the power source 14 one or another set resistors included as part of the light source driver circuit, or otherwise acting so as to provide a current level appropriate for the off-road mode of operation (such as by turning on and off current according to a duty cycle giving a desired average current value).

The embodiment shown in FIG. 9 uses an analog signaling current (provided by the power source 14 via a connection including a limiting resistor Rr) sufficient to control relays 17 for connecting one or more of the set resistors $R_1$, $R_2$ and $R_3$ and the actuator 11*d* to the power source 14.

The invention can be provided as a kit, including cabling for connecting interfaces between the various components. For example, the light source driver circuits and the mode switch must be electrically coupled, possibly directly and possibly indirectly, for example via a data bus (such as a CAN bus). Therefore, of course, the light source driver circuits and the mode switch must all have interfaces appropriate for such coupling. In case of direct coupling, for example, the interfaces would accommodate cabling plugging into the components, and of a suitable size depending on the current to be carried by the cabling.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A headlamp system for a vehicle, comprising:

a mode switch, having an interface to means interiorly accessible to an occupant of the vehicle for selecting from among a plurality of different headlamp beams, the mode switch having means for enabling switching to the selected headlamp beam;

two housings, each provided so as to be mountable on a vehicle in a headlamp position;

two light-reflector assemblies, one for each housing, installed in a respective one of the housings and each electrically coupled to the mode switch and having an interface for electrically coupling to a power source; and two driver circuits, one for each light source, coupled to the respective light source and to the mode switch, and providing a lower operating current in response to use of the mode switch to select an on-road beam than in response to use of the mode switch to select an off-road beam, wherein each light-reflector assembly includes only one light source and only one reflector, and the plurality of light beams includes an on-road low beam and an on-road high beam, and also includes at least one off-road beam differing from both on-road beams by providing a greater total radiated power.

2. A vehicular headlamp system as in claim 1, wherein the mode switch is responsive to an on/off selection, a high beam/low beam selection, and an on road/off road selection.

3. A vehicular headlamp system as in claim 1, wherein selecting off using the mode switch results in a running lights beam provided by each light-reflector assembly.

4. A vehicular headlamp system as in claim 1, wherein the electrical coupling of the mode switch to the light-reflector assembly provides current for powering the light source.

5. A vehicular headlamp system as in claim 1, wherein the electrical coupling of the mode switch and the light-reflector assembly provides current for operating relays included in the light-reflector assembly.

6. A vehicular headlamp system as in claim 1, wherein the electrical coupling of the mode switch and the light-reflector assembly provides a data signal conveying a message from the mode switch to a component of the light-reflector assembly.

7. A vehicular headlamp system as in claim 6, wherein the data signal is provided according to a vehicle bus standard designed to allow microcontrollers and devices to communicate with each other within a vehicle without a host computer.

8. A vehicular headlamp system as in claim 1, wherein the plurality of light beams also includes a running lights beam having a lower total radiated power than any of the other beams.

9. A vehicular headlamp system as in claim 8, further comprising a driver circuit for each light source, coupled to the mode switch and to the light source, for providing a lower operating current in response to use of the mode switch to select the running lights beam than in response to use of the mode switch to select any of the other beams.

10. A vehicular headlamp system as in claim 1, wherein each light-reflector assembly includes an actuator mechanically coupled to the respective reflector and electrically coupled to the mode switch, and wherein each reflector is pivotably attached to the housing so as to have one orientation in response to use of the mode switch to select a high beam and another orientation in response to use of the mode switch to select a low beam.

11. A vehicular headlamp system kit, comprising:

a mode switch, having an interface to means interiorly accessible to an occupant of the vehicle for selecting from among a plurality of different headlamp beams, the mode switch having means for enabling switching to the selected headlamp beam;

two housings, each provided so as to be mountable on a vehicle in a headlamp position;

two light-reflector assemblies, one for each housing, each installed in a respective one of the housings and each having an interface for electrically coupling to the mode switch and an interface for electrically coupling to a power source; and two driver circuits, one for each light source, having an interface for coupling to the respective light source and an interface for coupling to the mode switch, and providing a lower operating current in response to use of the mode switch to select an on-road beam than in response to use of the mode switch to select an off-road beam, wherein the light-reflector assembly includes only one light source and only one reflector, and the plurality of different headlamp beams includes an on-road low beam and an on-road high beam, and also includes at least one off-road beam differing from both on-road beams by providing a greater total radiated power.

* * * * *